United States Patent [19]

Fuller, Jr. et al.

[11] 4,050,435

[45] Sept. 27, 1977

[54] VALVE CONTROL FOR CYLINDER CUTOUT SYSTEM

[75] Inventors: Harold L. Fuller, Jr., Washington, D.C.; Joseph E. Stubbs, Wheaton, Md.

[73] Assignee: Harold L. Fuller, Jr., Washington, D.C.

[21] Appl. No.: 636,982

[22] Filed: Dec. 2, 1975

[51] Int. Cl.[2] ..... F02B 77/00

[52] U.S. Cl. ..... 123/198 F; 123/182; 251/63.4

[58] Field of Search ..... 123/198 P, 90.32, 90.47, 123/90.63, 182, 198 R, 1 R, DIG. 1, DIG. 7, 90.41, 90.43; 251/31, 63.4, 77, 78

[56] References Cited

U.S. PATENT DOCUMENTS

| | | | |
|---|---|---|---|
| 872,598 | 12/1907 | Watts et al. | 123/90.32 |
| 1,985,447 | 12/1934 | Grubbs | 123/198 F |
| 2,019,252 | 10/1935 | Cottingham | 123/198 F |
| 2,250,814 | 7/1941 | Rohlin | 123/198 F |
| 2,526,239 | 10/1950 | Kincaid | 123/90.32 X |
| 2,739,580 | 3/1956 | Brown | 123/90.63 |
| 2,745,391 | 5/1951 | Winkler | 123/198 F X |

*Primary Examiner*—Carroll B. Dority, Jr
*Assistant Examiner*—Ira. S. Lazarus
*Attorney, Agent, or Firm*—Bacon & Thomas

[57] ABSTRACT

A fluid-operated internal combustion engine cylinder cutout device selectively operable to function as a rigid extension of a valve pushrod, as a deactivating means between the pushrod and its respective valve, or as a fluid jack means for holding the valve associated with a pushrod open while the operation of the pushrod is unimpeded. The device enables normal operation of an engine cylinder intake or exhaust valve by its pushrod; selective deactivation of the intake valve operation by uncoupling the pushrod and its respective valve; and sustained opening of the exhaust valve, the valves being associated with an engine cylinder desired to be cut out from engine operation. Engine oil pressure may be used as the operating fluid of the cutout device, which is constituted of an outer cylinder; an inner hollow piston slidable in the cylinder and having a pair of axially aligned, fluid isolated chambers; and a small piston in one of the chambers. The pushrod end is slidably received in the opposite chamber, and fluid pressure lines are connected to fluid ports in the outer cylinder, the fluid ports being in communication with the chambers of the hollow piston. A control means, not disclosed, enables selective operation of the cutout device to enable an inlet valve to be in effect disconnected from the operating influence of its pushrod; to enable fluid actuation of the device whereby it forms a rigid extension of the pushrod for normal operation of an inlet or exhaust valve; and to enable a different fluid actuation of the device whereby it operates as an extensible ram or jack for holding an exhaust valve open while the pushrod operation is unimpeded.

11 Claims, 5 Drawing Figures

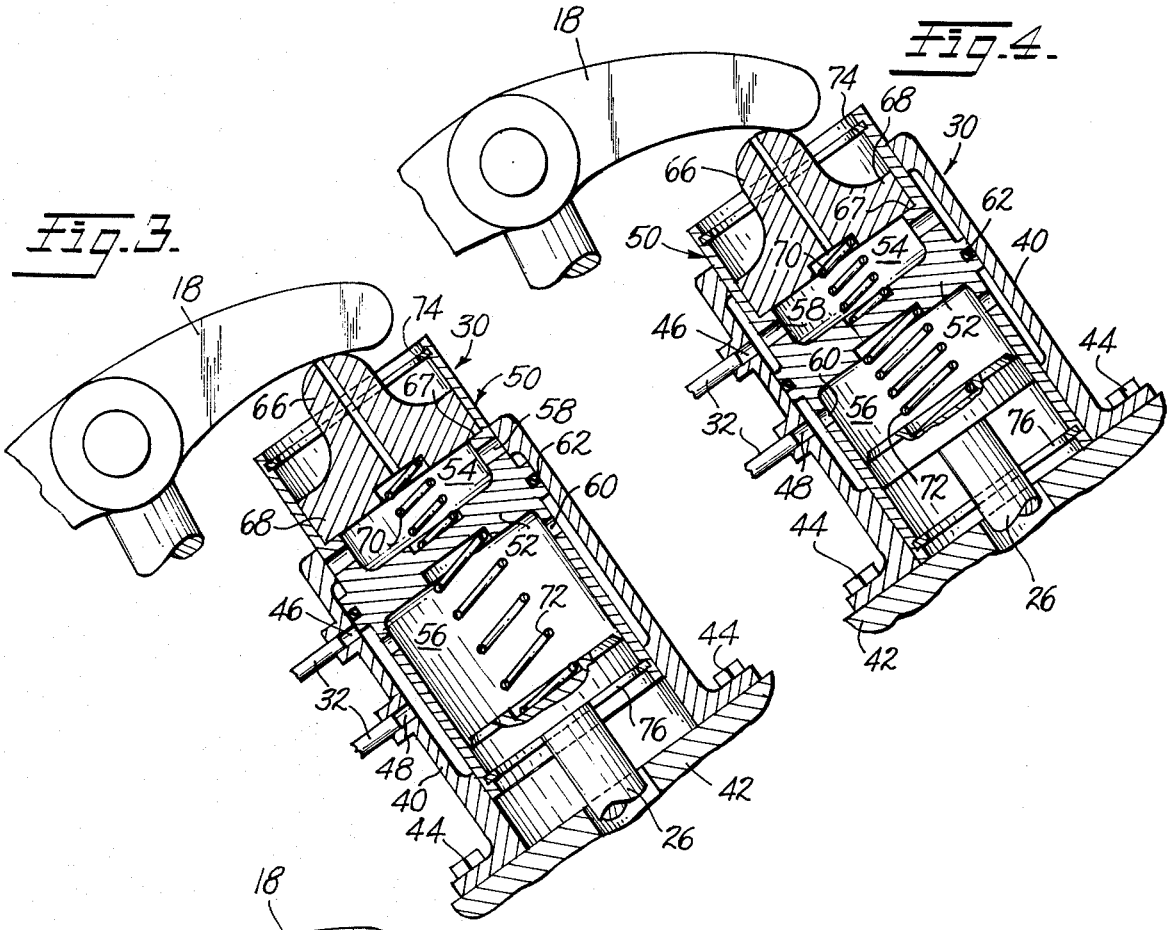
Fig. 3.
18
74
30
50
66
67
58
62
54
60
68
70
52
72
46
56
44
32
76
48
40
42
26
Fig. 4.
18
74
68
30
66
67
62
50
40
70
54
58
52
46
60
44
56
32
76
48
72
44
26
42
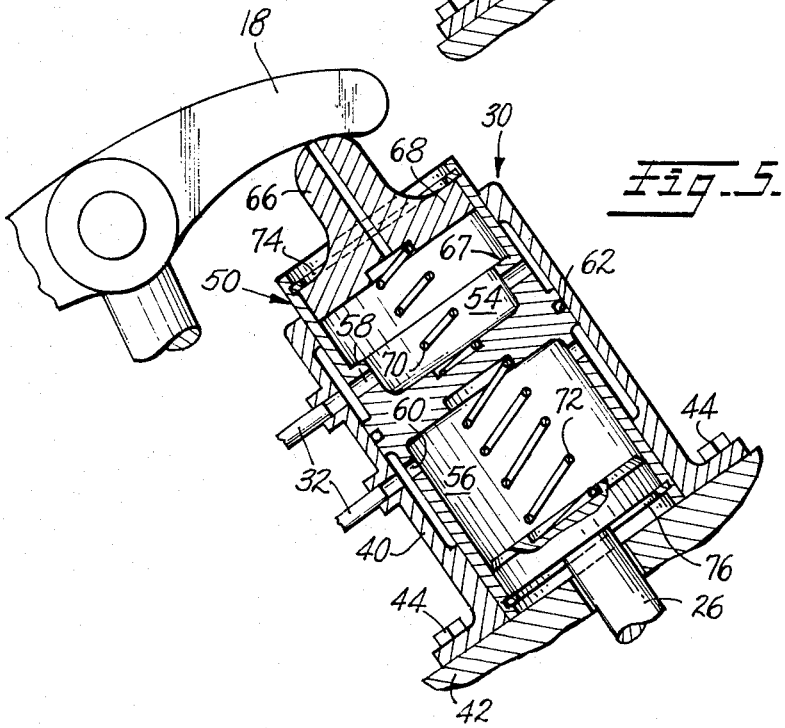
Fig. 5.
18
30
68
66
74
67
62
50
54
58
70
60
72
44
32
56
40
76
44
26
42

VALVE CONTROL FOR CYLINDER CUTOUT SYSTEM

BACKGROUND OF THE INVENTION

The present invention is an improvement in the field of cylinder cutout systems for internal combustion engines. Such systems are used to enable multiple cylinder engines to function with fewer than all of their cylinders to conserve fuel when less than full power operation of the engine is necessary. Thus, a larger displacement engine in effect can be converted in service to a smaller displacement engine, with the power loss incidental to such reduction being acceptable under light load conditions.

Cylinder cutout systems are well known in the prior art generally, including systems that attempt to modify the operation of the valves of the engine. The usual objective of these devices is to disable one or more of the cylinders of the engine by cutting off fuel thereto or otherwise affecting the cylinder operation so that the cylinder is dead as far as fuel consumption and power output are concerned.

An early patent teaching of a cylinder cutout system wherein fuel is cut off to a single bank of six cylinders in a V-12 engine, with the intake valve of the cut off bank being held closed and the exhaust valves open in the Jones U.S. Pat. No. 1,201,055, granted Oct. 10, 1916. In this example, the valve control system is an electromechanical arrangement adapted to work directly on the rocker arm of the valve train to hold the valve elements in the desired open or closed position when it is desired to deactivate the cylinders associated with the valves.

The present invention is an improved valve control system for enabling intake and exhaust valves of the cylinders of an engine to be held respectively closed and open to disable the cylinders of the engine and to conserve fuel and energy. The present system is a simple and efficient improvement over various complex and cumbersome prior art devices, most of which required a special engine design to accommodate them. The present invention, on the other hand, is designed specifically for installation in a simple manner in an existing conventional engine much in the same manner as any other engine accessory.

SUMMARY OF THE INVENTION

The invention is a fluid-operated valve pushrod elongating or shortening device that can be installed as an accessory in an existing engine using a pushrod and rocker arm valve train system. The system is controllable, in effect, to elongate the exhaust valve pushrods and to deactivate the intake valve pushrods for each cylinder to be cut out from engine operation. This system is also controllable so that the intake and exhaust valves may operate in the normal manner in response to the reciprocating movement of the pushrods. Engine oil pressure preferably serves as the actuating medium. The device permits full or partial engine operation under any control set up desired.

In use, the standard pushrod would be replaced with a modified pushrod of shorter length, and the invention would be installed between the shorter pushrod and the rocker arms of the valve actuating train. Control of fluid pressure supply to the device incorporating the invention enables the device to selectively function as a relatively solid extension of the pushrod for normal operation engine, as a shortened pushrod for the intake valves or as a fluid ram or jack for holding the exhaust valve open while the pushrod is still free to reciprocate.

The valve control device itself preferably comprises an outer relatively fixed cylinder which slidably supports for reciprocal movement therein a hollow piston element having opposed internal cylinder chambers at either end thereof; and a central dividing wall for isolating the chambers from each other. One of the chambers receives the end of the modified pushrod, which end fits closely in its respective chamber, and the opposite chamber receives a smaller inner piston element which engages the rocker arm. Springs are provided to normally bias the hollow piston away from the pushrod and to normally urge the inner piston towards the rocker arm relative to the hollow piston.

Preferably, engine oil under pressure is used as the operating fluid for the valve control device and any suitable control system can be used to selectively regulate its operation. Fluid supply to either internal chamber of the hollow piston enables the device to function as a normal pushrod, or as a hydraulic ram for holding the exhaust valve open against its closing spring. When no fluid pressure is supplied to the device, the pushrod action is neutralized and the rocker arm is not moved in response to pushrod motion, whereby intake valves will remain seated by their respective valve springs. In any mode of operation, however, the pushrod action is not interrupted or mechanically interfered with.

DETAILED DESCRIPTION

Description of the Drawings

In the accompanying drawings:

FIG. 3 shows a sectional side elevational view of the valve control embodying the present invention, with the control operating in the full engine operation mode; and FIGS. 4 and 5 are similar to FIG. 3 and show, respectively, the control device operating in the cylinder cutout mode with respect to the intake and exhaust valves of the engine.

DETAILED DESCRIPTION OF THE PREFERRED EMBODIMENT

Figure 1:
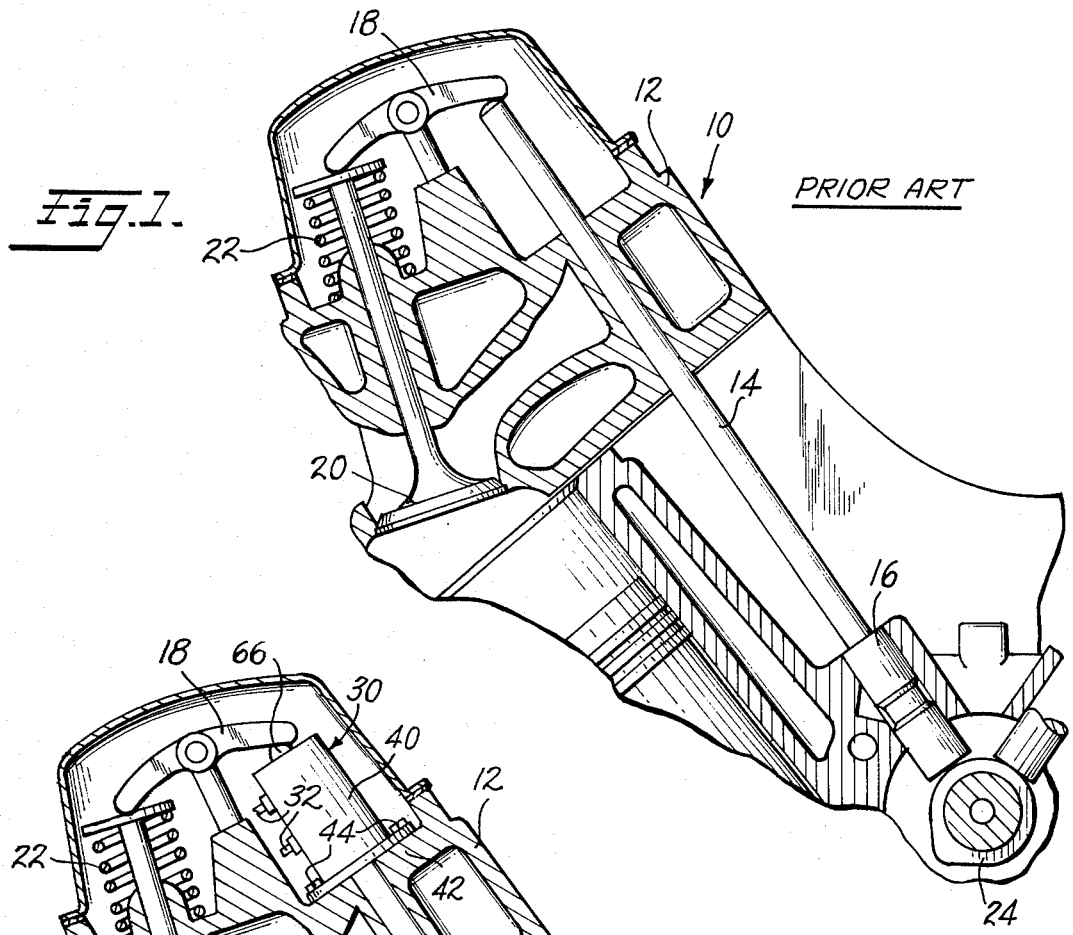
FIG. 1 shows a partial cut away segment of a typical valve train in an internal combustion engine, the valve train using hydraulic lifters, pushrods and rocker arms, conventionally referred to as tappets.
Figure 2:
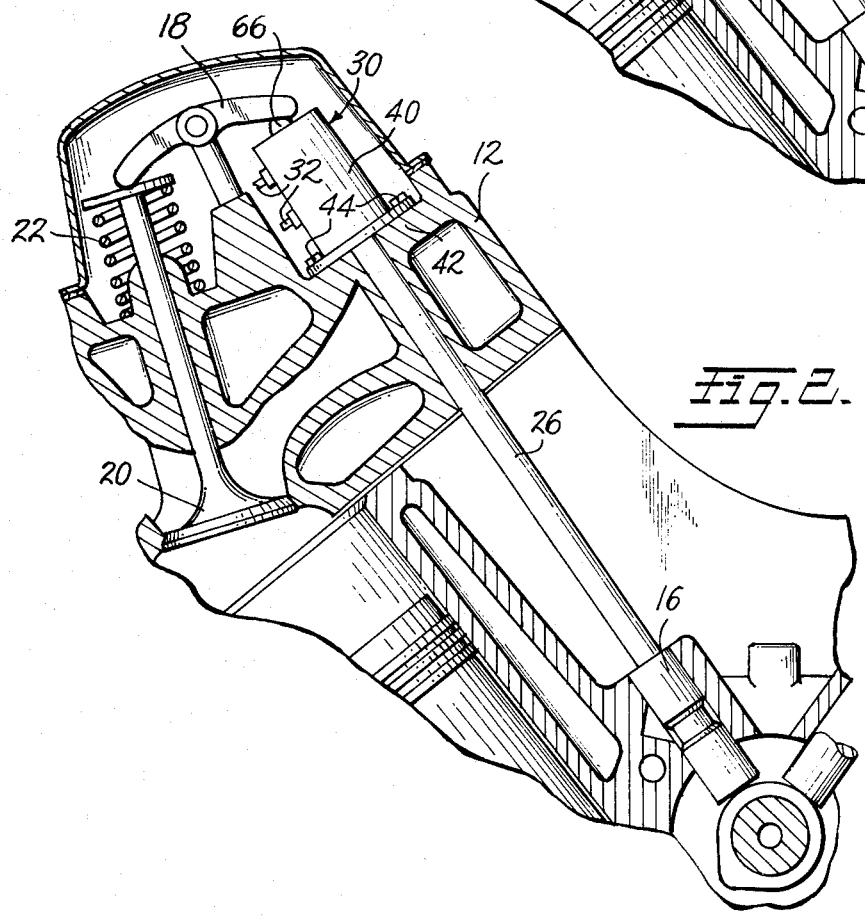
FIG. 2 shows a typical installation of a preferred embodiment of the invention in an engine such as shown in FIG. 1.

With references to FIGS. 1 and 2 in the appended drawings, a valve in-head internal combustion engine 10 of typical configuration and known in the prior art is shown to include a cylinder head 12 through which extend pushrods 14 disposed between hydraulic valve lifters 16 and rocker arms or tappets 18. Valves 20 are moved to open position by rocker arms 18 in a conventional manner and are seated by means of valve springs 22. Cam 24 drives the pushrod 16 (or the pushrods directly if a mechanical pushrod system is used) in timed sequence in a manner well known per se.

In accordance with the teaching of the present invention, a valve control device is installed in the valve actuating train between the pushrods (which are modified slightly from the factory installed pushrods) and the rocker arm, as shown in FIG. 2. In this view, modified pushrod 26 is installed and the valve control unit 30 is placed between the top end of the pushrod 26 and the rocker arm 18. Fluid connections 32 are made to the unit 30 and a suitable control system (not a part of the present invention) for controlling the flow of fluid pressure to the unit 30 completes the total system installation. A valve control unit 30 would be installed at each intake and exhaust valve of each cylinder of the engine desired to be deactivated or cut out upon demand.

In FIGS. 3–5, the valve control device of the present invention is shown in more detail, and the various operating modes thereof are illustrated.

In FIG. 3, the control device 30 comprises an outer cylinder that may be fixed relative to the cylinder head of the engine by any suitable means, such as bolts 44. Fluid pressure supply lines 32 (FIG. 2) conduct fluid pressure, preferably engine oil pressure, to the ports 46, 48 in the sidewall of cylinder 40. Concentrically positioned and supported for axially slidable motion within cylinder 40 is a hollow variable length piston element 50 that includes a central dividing wall section 52 separating the interior of the piston into two cylindrical chambers 54, 56. Chambers 54, 56 are in communication with ports 46 and 48, respectively through ports 58, 60. While a pair of ports 58 and a pair of ports 60 are illustrated, it will be readily appreciated that any number of ports could be utilized to provide communication between the chambers 54 and 56 and the inlet ports 46, 48 in the cylinder 40. The outer side of hollow piston 50 includes a seal element 62 which effectively prevents communication between ports 46 and 48 within cylinder 40. The seal 62 is shown as a land or piston 50, but just as readily could be an "O" ring seal or similar element fixed to either the cylinder 40 or the piston 50, as will be evident from the ensuing description, and which should be apparent to one who understands the operation of the invention.

Slidably received within each of chambers 54, 56 are, respectively, a small length varying piston 66 that is in engagement with the rocker arm 18 and the upper end of pushrod 26. Inner sidewall of chamber 54 includes a shoulder 67 that serves to limit the downward travel of piston 66 in chamber 54.

Piston 66 and head end 68 of rod 26 fit closely within their respective chambers in telescopic relationship so that fluid pressure admitted to ports 58 and 60 will be substantially maintained within chambers 54 and 56 within required limits. Compression springs 70, 72 urge small piston 66 towards its end position away from the pushrod (towards the rocker arm) and the hollow piston 50 also is urged away from the end of the pushrod in chamber 56. Locking rigs 74, 76 or the equivalent restrain the extreme outward motion of piston 66 and the rod end 68 axially beyond the ends of the hollow piston 62. Thus, it will be apparent that the normal position of the assembly of pushrod, pistons and springs is such that, in the absence of valve spring pressure applied downwardly on piston 66 via rocker arm 18, small piston 66 and hollow piston 50 are maintained at their maximum distances from the end 68 of pushrod 26. When the device 30 is installed, however, valve spring pressure acting on the device via rocker arm 18 tends to hold the smaller piston 66 bottomed on shoulder 67 in chamber 54, and the hollow piston 50 bottomed against the cylinder head 42, or whatever other bottom motion limiting means is utilized with respect to piston 50.

The device 30 would then appear as shown in FIG. 4, which illustrates the valve control device in operation to eliminate the pushrod motion exerted against the intake valve of a cylinder to be deactivated. Absence of hydraulic pressure in either chamber 54 or 46 results in the bottoming of pistons 66 and 50 and the pushrod 26 simply reciprocates freely within the bottom chamber 56. Rocker arm 18 will not therefore be acted upon by rod 26 which is urged against the valve lifter or the cam at the opposite end of the rod by means of spring 72.

For full engine operation, activation of the intake and exhaust valves which include the control device 30 in their valve trains is accomplished by supplying fluid pressure to port 48 to pressurize chamber 56. This results in the forming of a rigid hydraulic link between rod 26 and hollow piston 50. With small piston 66 bottomed and piston 50 held extended full length away from the top of rod 26, the rocker arm 18 receives the same input in response to reciprocal motion of pushrod 26 as in the case where the device 30 was not substituted for a full length pushrod (as shown in FIG. 1). Piston 50 then reciprocates within cylinder 40 along with rod 26 to activate rocker arm 18 in the usual manner.

When the control device 30 is used with an exhaust valve and it is desired to hold the exhaust valve open, fluid pressure is admitted to port 46 and is bled from port 48. As shown in FIG. 5, small piston 66 and hollow piston 50 are then driven apart to the limits of their outward motion, whereby the pistons 66 and 50 form two parts of a fluid ram or jack to force rocker arm 18 into a position where its respective exhaust valve is held open against the force of its own closing spring. Piston 50 is bottomed against the cylinder head in this configuration, while pushrod 26 may freely reciprocate within its chamber 56.

It should be evident that various modifications of the preferred embodiment illustrated and reversal of pistons and cylinders shown as being used can be made without departing from the spirit and intent of the present invention. Certain elements illustrated may also be eliminated in situations where their function is not critical or is optional, such as spring 70, for example. Moreover, it is envisioned that mechanical, electrical, or magnetic means, or a combination of these, could be used to selectively couple and uncouple the driving pushrod from its respective driven valve tappet, or to vary the length of the variable length hollow piston. In short, the invention is to be limited solely by the claims herein contained and not by the specific construction of the illustrated preferred embodiment.

I claim:

1. A device for selectively coupling or uncoupling a reciprocating pushrod member from a driven member, and for holding such driven member at an end-of-stroke position with respect to the pushrod member while the pushrod member motion is uninterrupted, the driven member having a return stroke driving means, comprising:

a. a support means disposed between a pushrod member and a driven member;

b. a variable length member connected to said support means and relatively movable with respect thereto;

c. coupling means on said variable length member for engaging a pushrod member;

d. means for selectively operating or deactivating said coupling means, whereby the variable length member may be selectively driven by a pushrod member when coupled thereto or, when uncoupled, not driven by same while the motion of the pushrod is unimpeded with respect to the variable length member;

e. length varying means movably attached to the variable length member for permitting relative motion between first and second limit positions, the variable length member being at minimum and maximum lengths, respectively, when said length-varying means is disposed at its first and second limit positions;

f. extension actuating means for selectively extending said length-varying means to its second limit position relative to said variable length member and holding the length-varying member at such position; and g. said length varying means being drivingly connected to said driven member.

2. The invention recited in claim 1 wherein said coupling means includes means for slidably engaging a pushrod member.

3. The invention recited in claim 1, wherein said coupling means includes means for slidably and telescopically receiving a pushrod member, whereby, when said coupling means is deactivated, the motion of a pushrod is unimpeded in slidable, telescopic relationship with respect to the variable length member.

4. The invention recited in claim 1, wherein said support means comprises a cylinder and said variable length member comprises a piston member concentrically disposed within said cylinder, and axially reciprocable therein.

5. The invention recited in claim 4, wherein said piston member includes hollow cylinder chambers at its opposite ends for receiving, respectively, the pushrod member and the length varying means.

6. The invention recited in claim 5, further including at least a portion of a pushrod member in the chamber for receiving said pushrod, the said portion comprising a pushrod piston axially slidably disposed in said chamber in relatively fluid sealing relationship, said piston in said chamber comprising a coupling means between said variable length member and said pushrod portion; stop means for preventing withdrawal of said pushrod portion from the chamber and limiting relative axial movement in an endwise direction between said variable length member and the pushrod portion; and wherein said means for selectively operating or deactivating said coupling means includes means for selectively and alternatively admitting and discharging fluid pressure to the said pushrod receiving chamber between the last said chamber and the said pushrod piston, the presence of fluid pressure in the chamber driving said variable length member against the stop means relative to the pushrod portion, and preventing relative axial motion between said pushrod portion and said variable length member, the absence of fluid pressure in the chamber allowing said pushrod portion to axially freely reciprocate within the chamber unimpededly.

7. The invention recited in claim 5, wherein said length varying means includes a length-varying piston portion, the length-varying piston portion disposed for axial movement in its respective cylinder chamber of said variable length member, and further wherein said extension actuating means includes means for selectively supplying fluid pressure to the cylinder chamber in which the length-varying portion is disposed for driving the length-varying piston portion to its outer limit position.

8. The invention recited in claim 6, wherein said length-varying means includes a length-varying piston portion, the length-varying piston portion disposed for axial movement in its respective cylinder chamber of said variable length member, and further wherein said extension actuating means includes means for selectively supplying fluid pressure to the cylinder chamber in which the length-varying portion is disposed for driving the length-varying piston portion to its outer limit position.

9. The invention recited in claim 8, wherein the pushrod member is a valve actuating pushrod in a pressurized oil lubricated internal combustion engine; said pressurized fluid comprising pressurized lubricating oil for the internal combustion engine; and said driven member comprising a valve tappet.

10. The invention recited in claim 9, wherein said engine includes a cylinder head through which said pushrod member extends, said support means being secured to said cylinder head between said pushrod and said tappet.

11. The invention recited in claim 10, further including compression spring elements in said chambers of said variable length member, said springs normally urging said variable length member and said length-varying means towards the said stop means and the said outer limit position, respectively.

* * * * *